US005193867A

United States Patent [19]

Husted

[11] Patent Number: 5,193,867

[45] Date of Patent: Mar. 16, 1993

[54] PORTABLE SECURITY DEVICE FOR A DOOR

[76] Inventor: Royce H. Husted, 711 Lakeside Dr., Wheaton, Ill. 60187

[21] Appl. No.: 876,333

[22] Filed: Apr. 30, 1992

[51] Int. Cl.[5] ..... E05C 19/18

[52] U.S. Cl. ..... 292/292; 292/295; 292/288

[58] Field of Search ..... 292/288, 290, 292, 295, 292/296, 297, 298

[56] References Cited

U.S. PATENT DOCUMENTS

| | | | |
|---|---|---|---|
| 588,619 | 8/1897 | Sullivan | 292/292 |
| 614,052 | 11/1898 | Jackson | 292/295 |
| 628,735 | 7/1899 | Wold | 292/292 |
| 663,036 | 12/1900 | Mitchell | 292/292 |
| 771,588 | 10/1904 | Taylor et al. | 292/298 |
| 794,400 | 7/1905 | Farrell | 292/292 |
| 811,594 | 2/1906 | Taylor | 292/292 |
| 1,128,363 | 2/1915 | Robinson | 292/292 |
| 2,461,398 | 2/1949 | Sands | 292/290 |
| 2,692,158 | 10/1954 | Tirschel | 292/346 |
| 3,411,817 | 11/1968 | Carver | 292/298 |
| 3,451,235 | 6/1969 | Weingart | 292/292 |
| 4,178,027 | 12/1979 | Charron | 292/346 |
| 4,189,175 | 2/1980 | Paxton | 292/340 |
| 4,279,436 | 7/1981 | Heffel | 292/346 |
| 4,383,709 | 5/1983 | Ronan | 292/346 |
| 4,489,968 | 12/1984 | Easley | 292/340 |
| 4,547,009 | 10/1985 | Allen | 292/346 |
| 4,583,776 | 4/1986 | Bouchard | 292/346 |
| 4,629,231 | 12/1986 | Bouchard | 292/346 |
| 4,809,400 | 3/1989 | Allen | 16/82 |
| 4,861,082 | 8/1989 | Priola et al. | 292/346 |
| 5,074,606 | 12/1991 | Priola et al. | 292/346 |

OTHER PUBLICATIONS

Instruction Sheet that accompanied the Portabolt TM portable locking device which is discussed in the specification.

*Primary Examiner*—Eric K. Nicholson
*Attorney, Agent, or Firm*—Nicholas A. Camasto

[57] ABSTRACT

A portable security device for preventing normal opening of a door includes a hard steel strap having a hooked end for engaging a doorjamb and an extension that includes a plurality of aligned rectangular apertures. A U-shaped clip is slidable along the strap extension and has a tang formed in one leg for engagement with any of the apertures. A spring-loaded plunger is captivated between the legs of the U-shaped clip with the plunger extending beyond the clip to engage a door and force the tang into one of the apertures during installation. A bow in the leg in which the tang is formed permits a small lock to preclude movement of the tang out of the aperture and makes the device useful for securing a drawer in a mating frame.

9 Claims, 2 Drawing Sheets

PORTABLE SECURITY DEVICE FOR A DOOR

BACKGROUND OF THE INVENTION AND PRIOR ART

This invention relates generally to supplementary security devices for conventional doors and particularly to a simple, low cost portable security device for precluding normal opening of a door.

Conventional lock arrangements for doors have a bolt which engages an opening in a strike plate that is secured to the doorjamb. It is well known that conventional key-operated bolts and strike plate arrangements are often easily defeated by the use of a thin tool or piece of plastic. This is especially true in doorframes that do not include a stop in the doorjamb that conceals the door/doorjamb interface. It is also well known that the security locks used in hotel rooms and the like are not "dead bolts" in that they may be opened from the outside with a key. Such security locks do, of course, provide a measure of protection and security for those in the room, while permitting the owner or other authorized personnel to enter the premises with a key in the event of an emergency or the like. It is also a known fact that the security system of any hotel or motel is necessarily impaired because of the need for servicing and cleaning when the room is vacant. Coupled with the fact that hotel and motel keys are often not returned, or are lost or misplaced, it becomes apparent that there may be a number of keys available for any particular room. To maintain security with so many keys in existence is extremely difficult. Consequently, there is a real danger that a stranger may possess a key to one's hotel room.

The prior art includes a number of devices for preventing the "jimmying" of door locks. Most of the devices require structural changes to the door or doorjamb and afford no protection against normal entry with a key. A device similar to the present invention is currently available to the public. It is of hardened steel and polycarbonate plastic and generally comprises a hook plate (for engaging a strike plate in a doorframe) is attached to a threaded bolt along which a body is slideable for engaging a closed door. A ratchet type locking device is also movable along the bolt against the body. When the body engages the door the ratchet trigger is released and the ratchet locking device is turned on the bolt via the now-engaged-threads of the bolt to clamp the body against the door. This secures the door from normal opening. The device is relatively complicated, expensive and has a tendency to resist removal due to binding of the trigger mechanism. It can be carried in a purse or briefcase and is therefore portable.

The security device of the present invention is simpler to manufacture and use, lower in cost and believed more effective in protecting against normal, nonforcible entry to the premises (by a key or simple "jimmying"). It, like the prior art device mentioned above, is not a barrier to a determined intruder who is willing to use force to break in. However, nonforcible entries are prevented. The device of the invention resists being dislodged by vibration and the like and is readily removable. The inventive device is also useful in conjunction with a small lock for securing closure elements, such as drawers to their mating frames for preventing unauthorized opening thereof.

OBJECTS OF THE INVENTION

A principal object of the invention is to provide an improved, portable security device for a door and doorjamb.

Another object of the invention is to provide a low cost, simple to use transportable security device for effectively thwarting nonforcible entries into hotel rooms and the like.

A further object of the invention is to provide an improved portable security device that is useful with most all door/doorjamb combinations.

A still further object of the invention is to provide a simple portable security device that may be used, in conjunction with a small lock, to secure a closure element to a mating frame.

BRIEF DESCRIPTION OF THE DRAWINGS

These and other objects and advantages of the invention will be apparent upon reading the following description in conjunction with the drawings, in which.

DESCRIPTION OF THE PREFERRED EMBODIMENT

Figure 8:
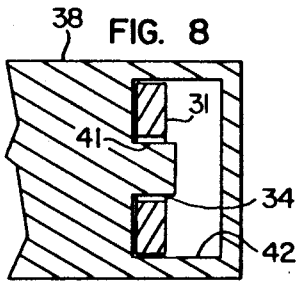
FIG. 8 is a sectional view along the line 8—8 of FIG. 2.

Referring to the figures and especially to FIGS. 1-7, a door and doorjamb assembly is generally shown in cross section. A pair of conventional doorknobs 10 and 2 are affixed to a door 14 and operate a bolt 16 by rotation thereof. Knobs 10 and 12 may include a keyed lock to preclude their being turned to move bolt 16 unless a key is used. A doorjamb 18 includes a conventional stop 20 for framing a door 14 and a cutout 22 for receiving a strike plate 24 of conventional design. A curved lip 26 is formed on the end of strike plate 24 to enable a ramp surface on the end of bolt 16 to cam the bolt inwardly against the action of a spring (not shown) during closure of the door. The security device 30 of the invention is shown installed between door 14 and doorjamb 18 to secure against nonforcible opening.

Figure 4:
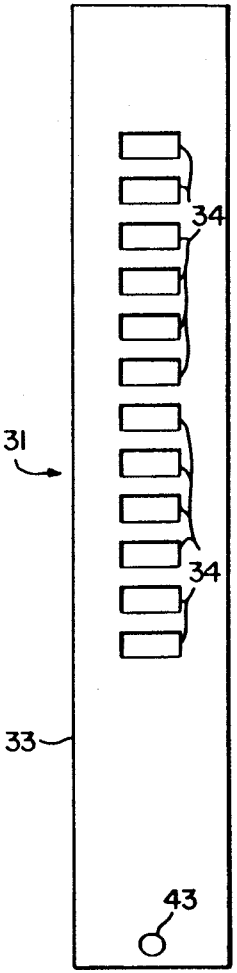
FIG. 4 is a plan view of the strap member of the security device.
Figure 3:
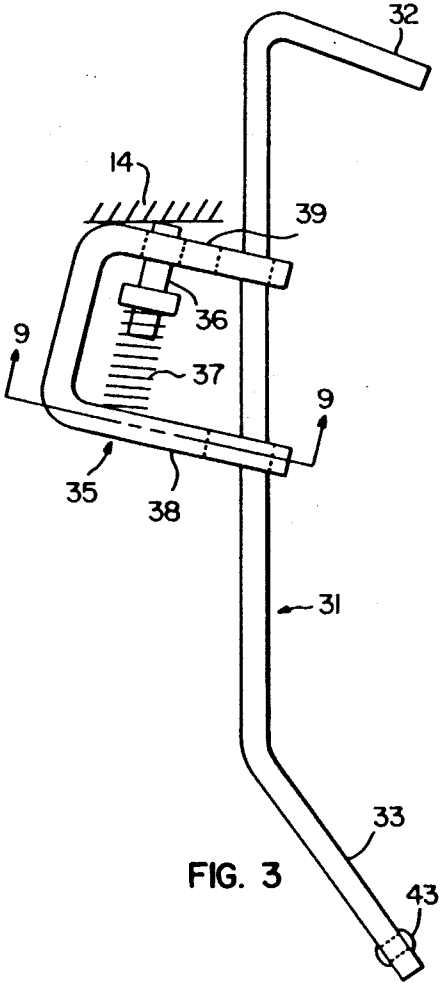
FIG. 3 is a similar view of the security device in its movable position.
Figure 2:
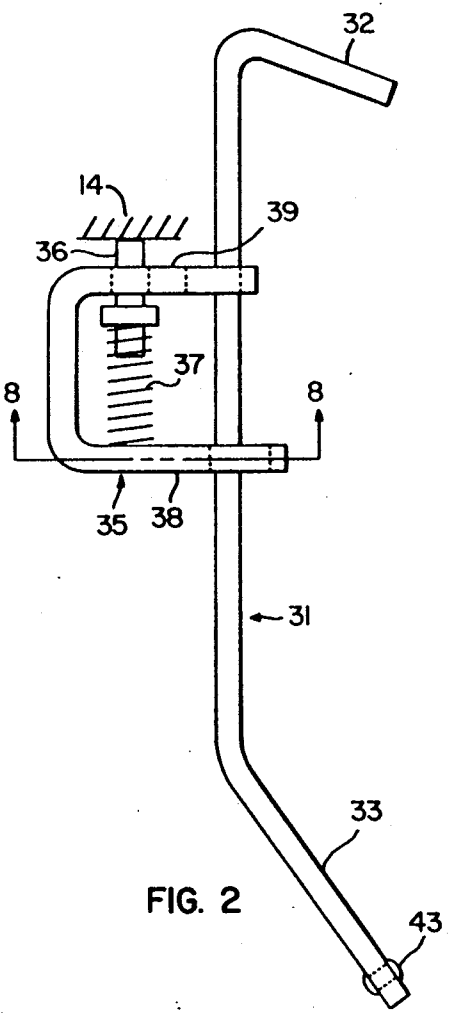
FIG. 2 is an enlarged view of the security device in its engaged position.

Referring specifically to FIGS. 2 and 3, enlarged views of the security device 30 of the invention are shown. The security device includes a metal strap member 31 having a hooked end 32 and an extension terminating in a bent out end 33. As seen in FIG. 4, a plurality of aligned rectangular apertures 34 are formed in strap member 31. A generally U shaped abutment member or clip 35 (FIGS. 5-7) is mounted for movement along strap member 31. Abutment member 35 includes a plunger 36 that is spring-loaded and captivated by a compression spring 37, between a pair of legs 38 and 39. Plunger 36 is urged against the inner surface of leg 39 and has a portion that extends beyond leg 39. Abutment member 35 is movable along strap member 31 by virtue of a pair of narrow rectangular windows formed in its legs. Specifically, a window 40 is formed in leg 39 and a window 42 is formed in leg 38. The windows are slightly longer than the width of strap member 31 and are sufficiently high to permit cocking (tilting) of abutment member 35 by the user, which is required to move it along strap member 31. Leg 38 includes a centrally disposed rectangular tang 41 that is sized to easily fit within any of the apertures 34. When installed, that is when the security device occupies the position shown in FIG. 2, tang 41 engages one of the apertures 34 to lock securing device 30 in place on strap member 31 with plunger 36 exerting pressure against leg 38 (through spring 37) by virtue of its engaging the door 14. By way of illustration strap member 31 may be about 4.0 inches long, 0.062 inches thick and 0.6 inches wide and is fabricated of hardened spring steel. The U-shaped abutment member 35 is fabricated of the same type of material.

Figure 9:
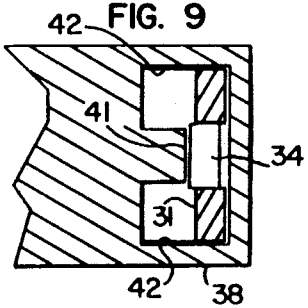
FIG. 9 is a sectional view along the line 9—9 of FIG. 3.

Operation of abutment member 35 to enable its movement along strap member 31 is best shown in FIGS. 3, 8 and 9. A hole is provided in the bent out end 33 for receiving a plastic rivet 43 or the like, of sufficient size to prevent disengagement of abutment member 35 and strap member 31, thus assuring that the security device is always ready for use. The security device 30 is installed by inserting hook end 32 of strap member 31 in the opening 22 in doorjamb 18 up against the bolt-contacting-inner surface of strikeplate 24. While holding bent out end 33 to maintain the hook end 32 engaged, the door 14 is closed and the abutment member 35 is tilted or cocked to disengage tang 41 from whichever aperture it is in. As best shown in FIG. 9, tilting the abutment member 35 disengages tang 41 from aperture 34, which permits the abutment member 35 to be slideably moved along the extension of strap member 31 until plunger 36 engages the surface of door 14. Plunger 36 is moved against spring 37 when the door is engaged and tang 41 is allowed to fall into the closest one of apertures 34. The spring 37 and plunger 36 take up any slack that may exist in the installation and keep the abutment member 35 securely in position with tang 41 fully engaging the selected one of apertures 34. This spring action has been found to maintain the security device 30 securely in place despite strong jostling or movement of the door in an effort to dislodge it. Any attempt to open door 14 results in the door surface forcing plunger 36 back until the door engages leg 39. The force on leg 39 (and leg 38) is transmitted to strap member 31 which is lodged at hook end 32 in doorjamb 18. During the process tang 41 remains firmly engaged in aperture 34. Release of the pressure of door 14 results in pluneer 36 extending out of leg 39 and maintaining engagement with the door.

It will be appreciated by those skilled in the art that the security device operates equally well for left-hand opening and right-hand opening doors. For such openings the security device is rotated 180 degrees along the axis of the strap member. It should also be noted that hook end 32 may simply be lodged against the outside edge of a doorjamb with equally effective results. Should no strike plate be present, such as often occurs with washroom door arrangements where the lock is missing. The security device may also be used, in conjunction with a conventional small lock, to secure a drawer or closure element from being opened without the exercise of force.

Figure 10:
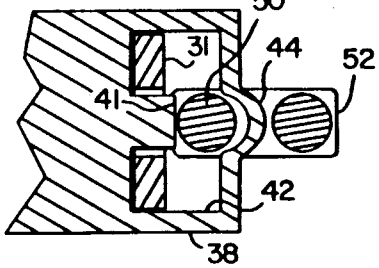
FIG. 10 is a modified version of the abutment member for use in conjunction with a small padlock.
Figure 1:
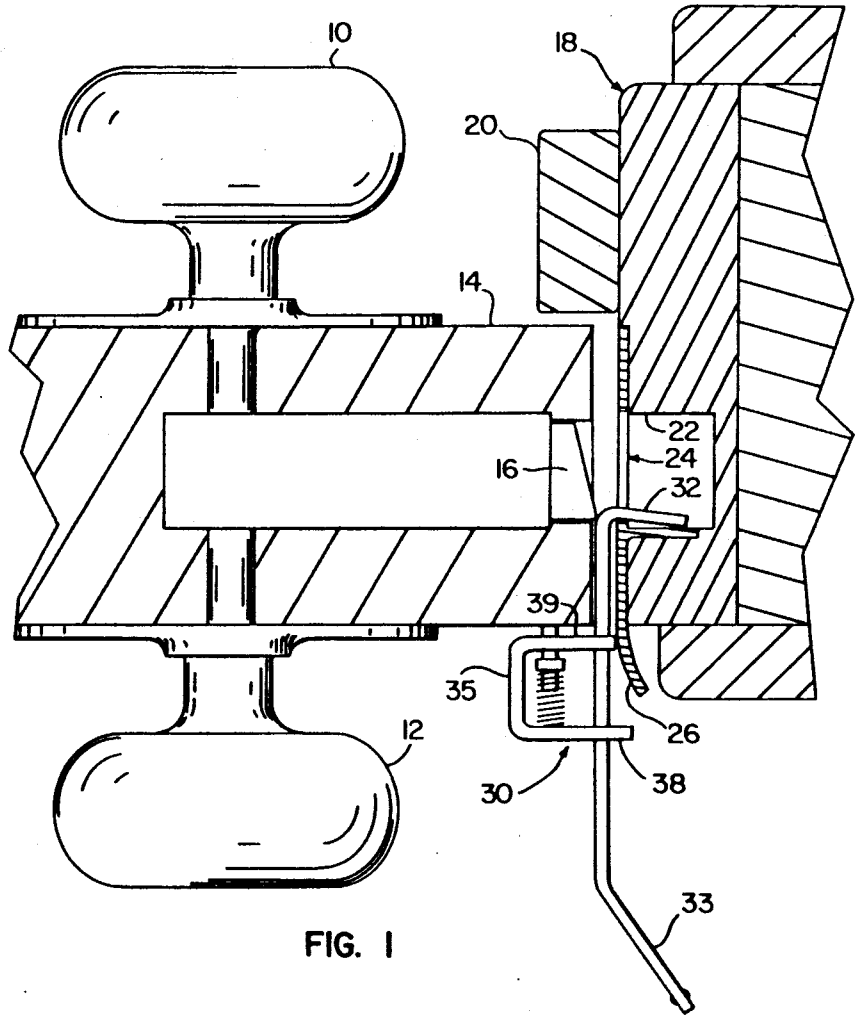
FIG. 1 is a partial cross-sectional view through a door and doorjamb assembly showing the security device of the invention in place.
Figure 7:
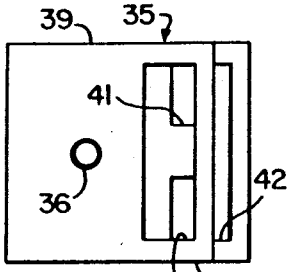
FIG. 7 is a top view of the abutment member of FIG. 5.
Figure 5:
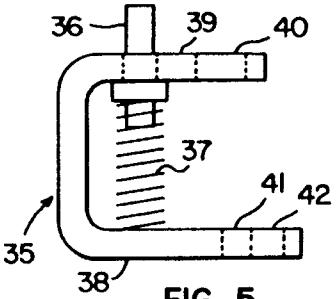
FIG. 5 is a elevation view of the movable abutment member of the security device.
Figure 6:
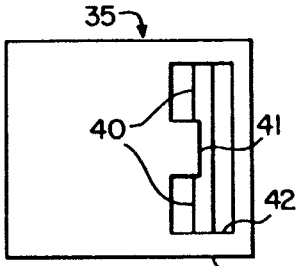
FIG. 6 is a bottom view of the abutment member of FIG. 5.

In FIG. 10, window 42 has been enlarged adjacent the end of tang 41 by means of a bend or arc 44 formed in the outer portion of leg 38. The hasp 50 of a padlock 52 is shown substantially filling the space between the end of tang 41 and the outer portion of leg 38. This prevents cocking of clip 35 with respect to strap 31 and hence keeps tang 41 in aperture 34. Thus a drawer or other closure element may be secured in a locked condition with respect to a mating frame with the device of the invention when used in conjunction with a simple, small padlock.

It is recognized that numerous changes in the described embodiment of the invention may be made without departing from its true spirit. The invention is to be limited only as defined in the claims.

What is claimed is:

1. A portable security device for use with a closure element and a mating frame comprising:

a strap-like retainer including a hook end for engaging a frame and an extension extending beyond the frame;

a plurality of apertures in said extension;

a generally U-shaped clamp adjustably positionable along said extension for engaging a closure element when in closed position relative to the frame, said clamp including a tang mating engageable with any of said apertures; and spring means urging said tang into mating engagement with a selected one of said apertures when said security device is installed, said spring means including a spring-loaded plunger captivated between the legs of said U-shaped clamp, said plunger, when engaging said closure element, urging said tang toward said strap-like retainer.

2. The device of claim 1 wherein said extension includes a portion that is bent away from said closure element to facilitate installation of said security device.

3. The device of claim 2 wherein the extreme end of said extension includes a hole for receiving a rivet or the like of sufficient size to prevent removal of said clamp from said extension.

4. The device of claim 1 wherein said tang is formed in a window in one of said legs of said clamp, and wherein said window is enlarged adjacent said tang for permitting a locking device to be inserted therein to prevent movement of said camp and disengagement of said tang.

5. A portable security device for use with a door and a mating doorjamb comprising:

a strap-like retainer including a hook end for engaging a spring plate in a doorjamb and an extension, including a plurality of rectangular apertures extending beyond the doorjamb;

a U-shaped clamp having first and second legs defining first and second windows through which said extension extends, said second window including a tang for engagement with any of said apertures and being sized to permit disengagement of said tang from said apertures to enable sliding movement of said clamp along said extension; and a spring-loaded plunger, captivated between the legs of said clamp and extending beyond said first leg, for engaging a door in closed position relative to the doorjamb.

6. The device of claim 5 wherein said extension includes a portion that is bent away from said door to facilitate installation of said security device.

7. The device of claim 6 wherein the extreme end of said extension includes a hole for receiving a rivet or the like of sufficient size to prevent removal of said clamp from said extension.

8. The device of claim 5 wherein said second window includes an enlarged area opposite said tang for permitting immobilization of said clamp on said retainer by the installation of a locking device in said window.

9. A method of precluding normal opening of a door mounted in a doorjamb comprising:

supporting a thin strap-like retainer, having an extension forming a plurality of rectangular locking apertures and a doorjamb engaging hook portion, between the doorjamb and the door;

cocking a spring-loaded U-shaped locking member to move a locking tang in a leg of said U-shaped member away from said extension;

sliding the locking member along the extension into engagement with the closed door; and releasing the locking member to permit spring-loaded engagement of said tang with an adjacent locking aperture to secure said locking member in position, said locking member comprising a spring-loaded plunger captivated between the legs of said U-shaped member and extensibly engaging the closed door.

* * * * *

UNITED STATES PATENT AND TRADEMARK OFFICE

CERTIFICATE OF CORRECTION

PATENT NO. : 5,193,867

DATED : March 16, 1993

INVENTOR(S) : Royce H. Husted

It is certified that error appears in the above-identified patent and that said Letters Patent is hereby corrected as shown below:

Column 4, line 52, delete "camp", insert --clamp--.

Signed and Sealed this

Fourth Day of January, 1994

*Attest:*

*Attesting Officer*

Bruce Lehman

BRUCE LEHMAN

*Commissioner of Patents and Trademarks*